US009785080B2

(12) United States Patent
Hanano

(10) Patent No.: US 9,785,080 B2
(45) Date of Patent: Oct. 10, 2017

(54) IMAGE CARRIER UNIT AND IMAGE FORMING APPARATUS INCLUDING THE SAME

(71) Applicant: KYOCERA Document Solutions Inc., Osaka (JP)

(72) Inventor: Susumu Hanano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/197,040

(22) Filed: Jun. 29, 2016

(65) Prior Publication Data

US 2017/0023874 A1 Jan. 26, 2017

(30) Foreign Application Priority Data

Jul. 21, 2015 (JP) ..... 2015-143913

(51) Int. Cl.
*G03G 15/02* (2006.01)

(52) U.S. Cl.
CPC ..... *G03G 15/0225* (2013.01)

(58) Field of Classification Search
CPC ..... G03G 15/0225; G03G 15/0266
See application file for complete search history.

(56) References Cited

U.S. PATENT DOCUMENTS 5,572,293 A * 11/1996 Kikuchi ..... G03G 15/0225 361/225
5,630,199 A * 5/1997 To ..... G03G 15/0216 361/225
6,334,034 B1 * 12/2001 Kitazawa ..... G03G 15/0225 399/100
2010/0092223 A1 * 4/2010 Kinokuni ..... G03G 21/0064 399/354
2010/0119253 A1 * 5/2010 Miyaji ..... G03G 21/0035 399/100
2013/0058679 A1 * 3/2013 Shono ..... G03G 15/0258 399/100

FOREIGN PATENT DOCUMENTS

JP 2007155844 A * 6/2007 ..... G03G 15/0225
JP 2008-40225 A 2/2008
JP 2008-89636 A 4/2008
JP 2015025931 A * 2/2015

* cited by examiner

*Primary Examiner* — Sevan A Aydin
(74) *Attorney, Agent, or Firm* — Stein IP, LLC

(57) ABSTRACT

An image carrier unit of the present disclosure includes an image carrier, a charging device, a unit housing and a drive mechanism. The charging device is fittable to and removable from the unit housing in a direction perpendicular to its longitudinal direction, and has a charging member and a cleaning member for cleaning the charging member. The drive mechanism has a biasing member for biasing a rotating shaft of the cleaning member in a first direction extending along its axial direction, and a moving member for moving the rotating shaft of the cleaning member in a second direction opposite to the first direction. An engaging portion to engage with an engaged portion provided on the unit housing side is formed at one longitudinal end portion of the charging device, and an engagement state between the engaging portion and the engaged portion is retained by biasing force of the biasing member.

4 Claims, 12 Drawing Sheets

IMAGE CARRIER UNIT AND IMAGE FORMING APPARATUS INCLUDING THE SAME

INCORPORATION BY REFERENCE

This application is based upon and claims the benefit of priority from the corresponding Japanese Patent Application No. 2015-143913 filed on Jul. 21, 2015, the entire contents of which are incorporated herein by reference.

BACKGROUND

The present disclosure relates to image forming apparatuses using an electrophotographic system such as copiers, printers, facsimiles and multifunction peripherals of these devices. More specifically, the present disclosure relates to an image carrier unit in which an image carrier and a charging device for charging the image carrier are unitized, as well as to an image forming apparatus including the image carrier unit.

In image forming apparatuses, conventionally, a charging device is used to electrically charge the surface of a photosensitive drum, which is an image carrier. Two types of charging devices are known, one being the corona charging system in which with a photosensitive drum and a corona wire disposed out of contact therebetween, the surface of the photosensitive drum is electrically charged by corona discharge, and the other being the contact charging system in which a charging roller or other charging member is brought into contact with the surface of the photosensitive drum to charge the surface. However, in recent years, for reduction of emission amounts of ozone, which is harmful to the human body, the contact charging system involving less ozone emission has been being adopted increasingly.

Such charging devices as described above are in many cases provided as unitized with a photosensitive drum into an image carrier unit. For example, the charging device is made fittable to and removable from the unit main body so as to facilitate maintenance, replacement or the like of the charging device.

In the contact charging system, when a charging roller is put into contact with the surface of the photosensitive drum, foreign matters such as toner and paper dust of sheets may stick onto the surface of the photosensitive drum and then move to the outer peripheral surface of the charging roller. Foreign matters sticking to the outer peripheral surface of the charging roller give rise to charging failures on the surface of the photosensitive drum, making a cause of large influences on image quality.

Accordingly, there has been proposed a structure including a cleaning member for cleaning the charging roller. For example, a charging device is known which includes: a support member for rotatably supporting a charging roller and moreover rotatably and axially-reciprocatably supporting a cleaning member; a disc-shaped cam member which is provided on a rotating shaft of the cleaning member and which is inclined by a specified angle from a direction perpendicular to the axial direction; and a guide member provided inside the housing. As the cleaning member is rotated, the cam member is guided by the guide member so that the cleaning member with the cam member provided thereon is reciprocatively moved along the axial direction in accordance with the inclination of the cam member. As a result of this, the outer peripheral surface of the charging roller is cleaned.

SUMMARY

An image carrier unit according to one aspect of the present disclosure includes an image carrier, a charging device, a unit housing, and a drive mechanism. The image carrier is to have an electrostatic latent image formed thereon. The charging device includes a charging member for electrically charging a surface of the image carrier by making contact with the image carrier, a cleaning member for cleaning the charging member by making contact with the charging member, and a frame for rotatably supporting a rotating shaft of the charging member and moreover rotatably and axially-movably supporting a rotating shaft of the cleaning member. The unit housing integrally holds the image carrier and the charging device. The drive mechanism includes a biasing member for biasing the rotating shaft of the cleaning member in a first direction extending along its axial direction, and a moving member for moving the rotating shaft of the cleaning member against biasing force of the biasing member with a constant periodicity in a second direction opposite to the first direction, the drive mechanism serving for reciprocatively moving the rotating shaft of the cleaning member in the axial direction. The charging device is fittable to and removable from the unit housing in a direction perpendicular to its longitudinal direction. An engaging portion to engage with an engaged portion of the unit housing is formed at one longitudinal end portion of the charging device, and an engagement state between the engaging portion and the engaged portion is retained by biasing force of the biasing member protruding from the other longitudinal end portion of the charging device.

Still further objects of the present disclosure and concrete advantages obtained by the disclosure will become more apparent from the following description of an embodiment thereof.

DETAILED DESCRIPTION

Figure 1:
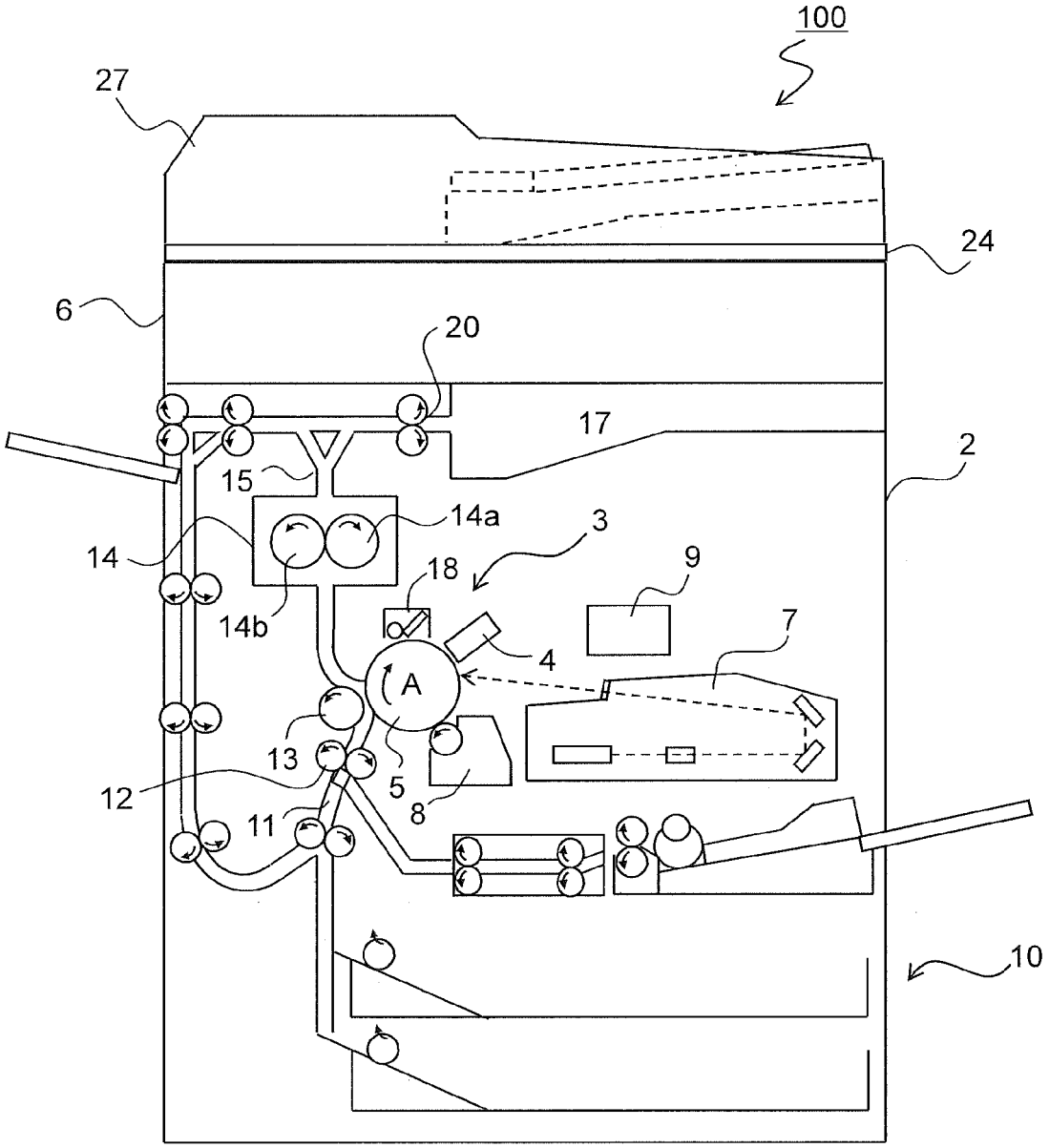
FIG. 1 is a view showing an overall configuration of an image forming apparatus 100 including a drum unit 30 of the present disclosure.

Hereinbelow, an embodiment of the present disclosure will be described with reference to the accompanying drawings. FIG. 1 is a view showing an overall configuration of an image forming apparatus 100 including a drum unit 30 of the present disclosure. A cassette-type sheet feed part 10 is provided in lower part of the image forming apparatus 100 (exemplified by a digital multifunction peripheral in this case). Sheets of paper stored in the sheet feed part 10 are picked out one by one, being fed out onto a sheet conveyance path 11.

The sheet conveyance path 11 is placed on the left side of the sheet feed part 10. A sheet fed out from the sheet feed part 10 is conveyed to a registration roller pair 12 located upward of the sheet conveyance path 11. The registration roller pair 12 feeds out each sheet toward an image forming part 3 in synchronism with the timing at which a toner image is transferred onto the sheet.

A document reading device 6 is provided in upper part of the image forming apparatus 100. A platen (document holder) 24 is openably/closably provided on top of the document reading device 6, and moreover a document conveyance device 27 is additionally provided on the platen 24.

In generally central part of the image forming apparatus 100, the image forming part 3 is provided. The image forming part 3 includes a photosensitive drum 5 serving as an image carrier, and moreover around the photosensitive drum 5 along its rotational direction ('A' direction in the figure), includes sequentially a charging device 4, an exposure unit 7, a developing device 8, a transfer roller 13, and a cleaning device 18. Toner supply to the developing device 8 is performed from a toner container 9. The cleaning device 18, having a cleaning member such as a blade, brush or polishing roller, scrapes and collects toner remaining on the surface of the photosensitive drum 5 with the cleaning member. The charging device 4, the photosensitive drum 5 and the cleaning device 18 are unitized. The unit constituted of the charging device 4, the photosensitive drum 5 and the cleaning device 18 will hereinbelow be referred to as drum unit 30.

When the surface of the photosensitive drum 5 is charged uniformly with specified polarity and voltage by the charging device 4, the exposure unit 7 forms an electrostatic latent image of the document image on the photosensitive drum 5 based on image data of the document read by the document reading device 6.

The developing device 8 supplies charged toner onto the surface of the photosensitive drum 5 to develop the electrostatic latent image on the photosensitive drum 5, thereby forming a toner image. The toner image is transferred onto the sheet by the transfer roller 13. The sheet with the toner image transferred thereto is conveyed to a fixing device 14. After the toner image has been transferred onto the sheet, the toner remaining on the surface of the photosensitive drum 5 is cleaned and collected by the cleaning device 18, and further residual charge on the surface of the photosensitive drum 5 is eliminated by an unshown charge eliminating device.

The fixing device 14, having a heat source-containing fixing roller 14*a* and a pressure roller 14*b*, pressurizes and heats the sheet with the toner image transferred thereon by the fixing roller 14*a* and the pressure roller 14*b*, thereby fusing and fixing the toner image on the sheet. The sheet with the toner image fixed thereon is discharged to an in-body discharge part 17 by a discharge roller 20.

Figure 2:
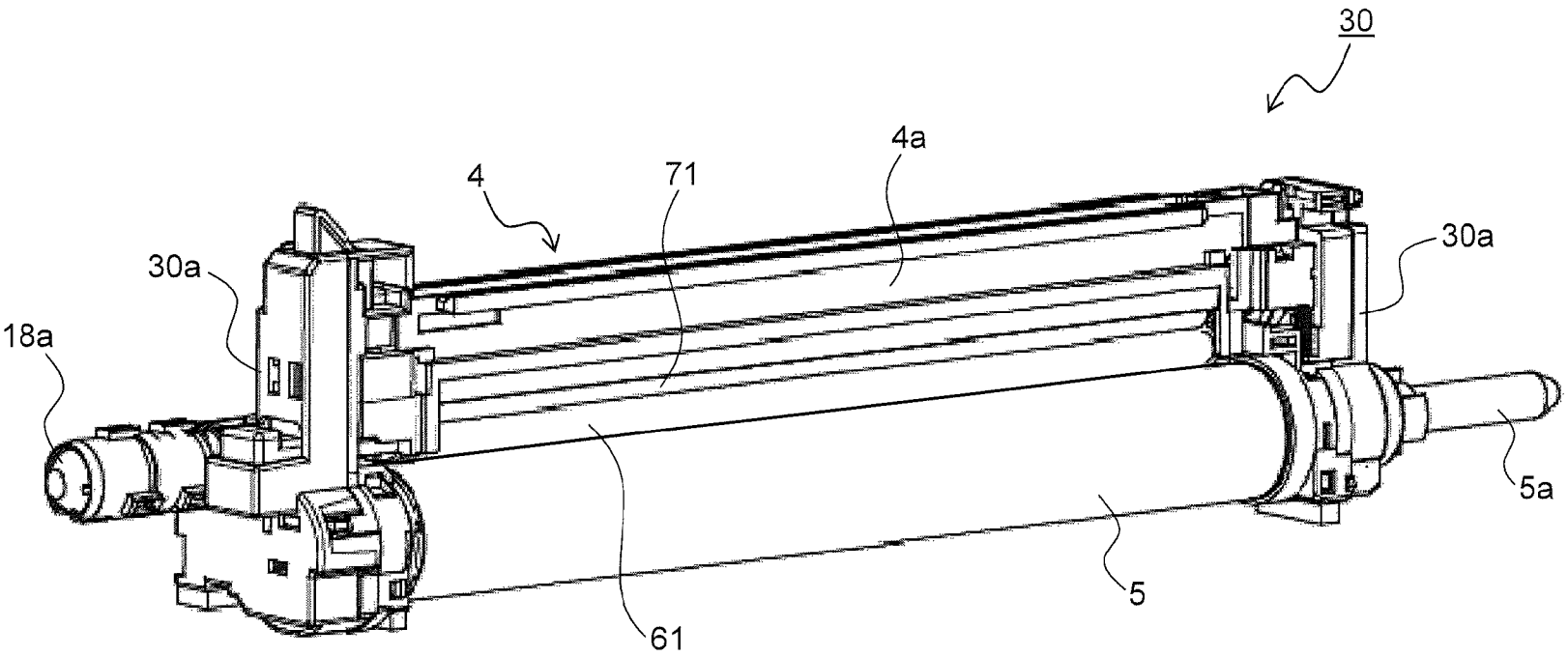
FIG. 2 is an appearance perspective view of the drum unit 30 according to one embodiment of the present disclosure.
Figure 3:
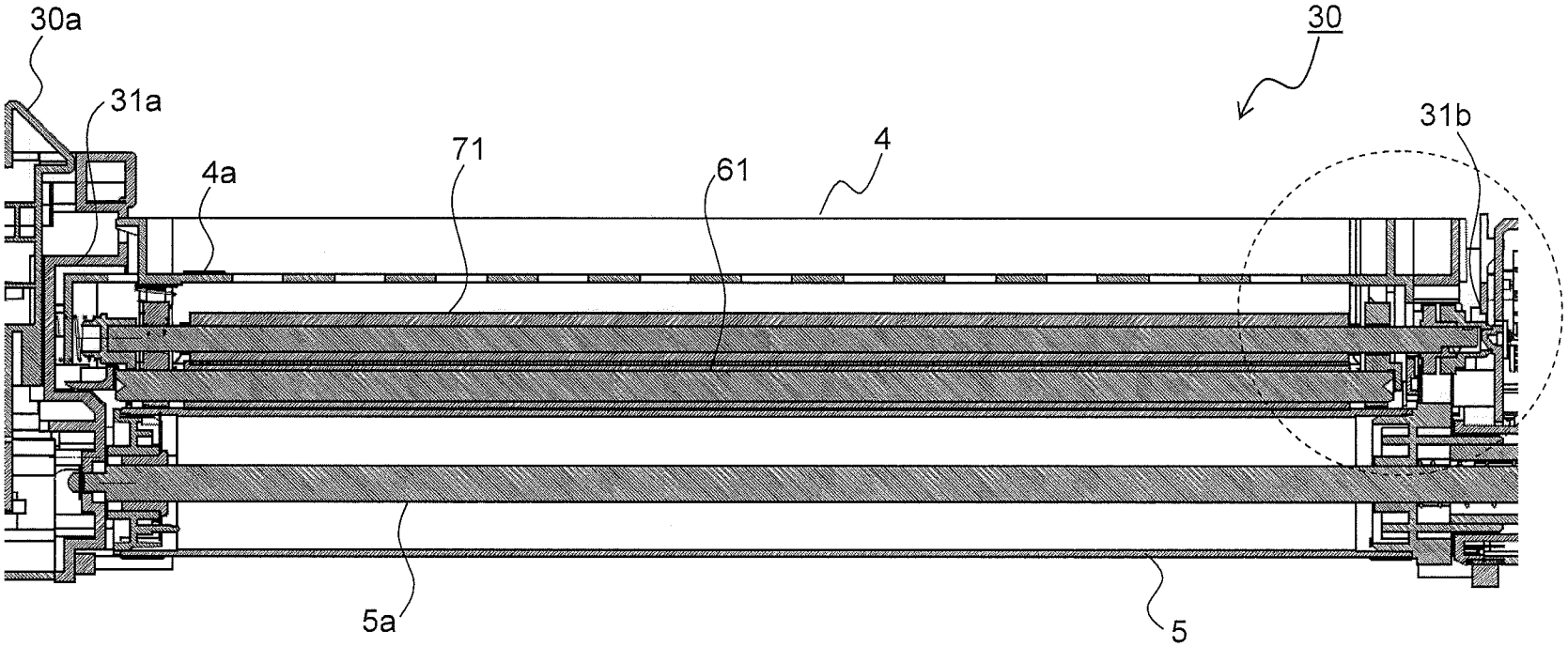
FIG. 3 is a side sectional view of the drum unit 30 as it is cut off along a longitudinal direction.

FIG. 2 is an appearance perspective view of the drum unit 30 according to one embodiment of the disclosure. FIG. 3 is a side sectional view of the drum unit 30 as it is cut off along a longitudinal direction. As shown in FIG. 2, the drum unit 30 has a unit housing 30*a* for holding the photosensitive drum 5, the charging device 4 and the cleaning device 18 (see FIG. 1). A drum shaft 5*a* of the photosensitive drum 5 is protruded from one end side (right side in FIG. 2) of the drum unit 30. By the drum shaft 5*a* being fitted to a shaft hole (not shown) on the main body side of the image forming apparatus 100, the photosensitive drum 5 is positioned into a specified position in the main body of the image forming apparatus 100.

Also, a toner disposal port 18*a* of the cleaning device 18 is protruded from the other end side (left side in FIG. 2) of the drum unit 30. Disposal toner collected by the cleaning device 18 is discharged from the toner disposal port 18*a*, and conveyed to a collection container via a disposal toner conveyance path (neither shown).

The unit housing 30*a* rotatably supports, at its both end portions, the drum shaft 5*a* of the photosensitive drum 5. A first accommodating portion 31*a* is provided on a one-end-side (left side in FIG. 3) inner side face of the unit housing 30*a*, while a second accommodating portion 31*b* is provided on the other-end-side (right side in FIG. 3) inner side face of the unit housing 30*a*. The first accommodating portion 31*a* accommodates therein an end portion of the charging device 4 on one side opposite to the drive mechanism 80 side (see FIGS. 5 and 6), while the second accommodating portion 31*b* accommodates therein the drive mechanism 80-side end portion of the charging device 4.

Figure 4:
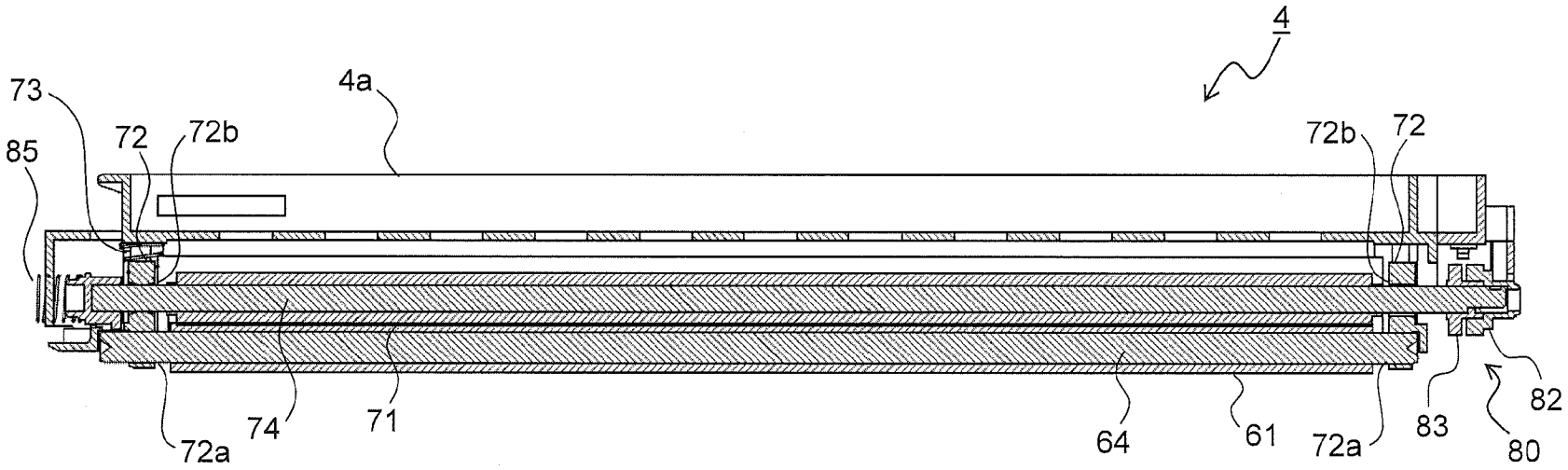
FIG. 4 is a side sectional view of a charging device 4, which is to be fitted to the drum unit 30, as it is cut off along an axial direction of a charging roller 61 and a cleaning member 71.

FIG. 4 is a side sectional view of the charging device 4, which is to be fitted to the drum unit 30, as it is cut off along the axial direction of the charging roller 61 and the cleaning member 71. The charging device 4 includes a frame 4*a*, the charging roller 61 rotatably supported by the frame 4*a*, the cleaning member 71, a pair of bearing members 72 for supporting both ends of a rotating shaft 64 of the charging roller 61 and a rotating shaft 74 of the cleaning member 71, and the drive mechanism 80 for rotationally driving the cleaning member 71 and moreover reciprocatively moving the same along the axial direction.

The charging roller 61 is an electroconductive rubber roller in which a rubber or other elastic layer is formed on a peripheral surface of the metallic rotating shaft 64. The charging roller 61, being in pressure contact with the photosensitive drum 5 with a specified nip pressure, rotates in subordination to the photosensitive drum 5. In image formation, a charging bias is applied to the charging roller 61 via the rotating shaft 64, so that the surface of the photosensitive drum 5 is electrically charged.

The cleaning member 71, which is intended to eliminate toner, paper dust of sheets and the like sticking on the charging roller 61, is formed into a brush shape in which electroconductive nylon or other resin is planted on the surface of the rotating shaft 74. The cleaning member 71 extends in parallel to the rotating shaft 64 of the charging roller 61 while being in contact with the surface of the charging roller 61 on the upper side of the charging roller 61 (on the side opposite to the photosensitive drum 5 side). Also, the rotating shaft 74 of the cleaning member 71 is supported so as to be reciprocatively movable in the axial direction. The cleaning member 71 may instead be a sponge-like roller made of rubber or resin.

The bearing members 72 are formed from synthetic resin having electrical conductivity. Each bearing member 72 is supported by the frame 4*a* so as to be positioned relative thereto in both the axial direction of the charging roller 61 (in the left/right direction in FIG. 4) and the widthwise direction of the frame 4*a* (in a direction perpendicular to the drawing sheet of FIG. 4). On the other hand, the bearing member 72 is supported so as to be movable in the direction of going nearer to or farther from the photosensitive drum 5 (in the up/down direction in FIG. 4). The bearing member 72 includes a bearing hole 72*a* for rotatably supporting the rotating shaft 64 of the charging roller 61, and a bearing hole 72*b* for rotatably and axially-reciprocatably supporting the rotating shaft 74 of the cleaning member 71. Since a distance between the two bearing holes 72*a*, 72*b* is set equal for the pair of bearing members 72, the rotating shaft 64 of the charging roller 61 and the rotating shaft 74 of the cleaning member 71 are supported by the bearing members 72 at such a constant distance therebetween that the cleaning member 71 is held in uniform contact with the surface of the charging roller 61.

Each pressure spring 73, being in contact with an upper portion of the bearing member 72 as well as in contact with an upper-face inner side of the frame 4*a*, biases the bearing member 72 toward the photosensitive drum 5 (downward in FIG. 4). That is, by biasing force of the pressure springs 73 provided at both end portions of the frame 4*a*, the charging roller 61 is pressed at a specified nip pressure into contact with the surface of the photosensitive drum 5 via the bearing members 72. Also, each pressure spring 73, being formed into a coil shape with a metal wire material, is connected to a high-voltage power supply (not shown) of the image forming apparatus 100 main body so as to allow a specified voltage to be applied to the charging roller 61 via the bearing members 72 and the rotating shaft 64. In addition, the pressure spring 73 to be put into contact with the right-side bearing member 72 is omitted in FIG. 4.

Figure 5:
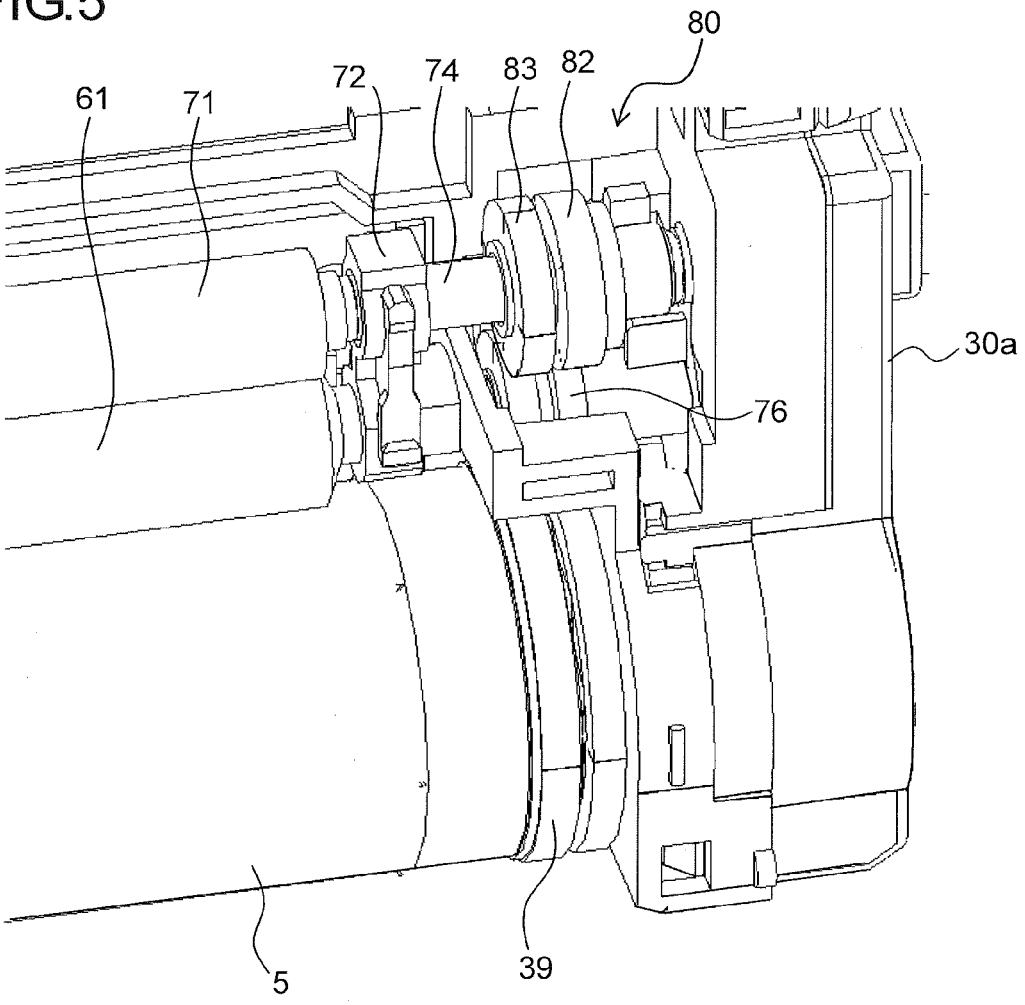
FIG. 5 is a partial perspective view of around a drive mechanism 80 of the drum unit 30.
Figure 6:
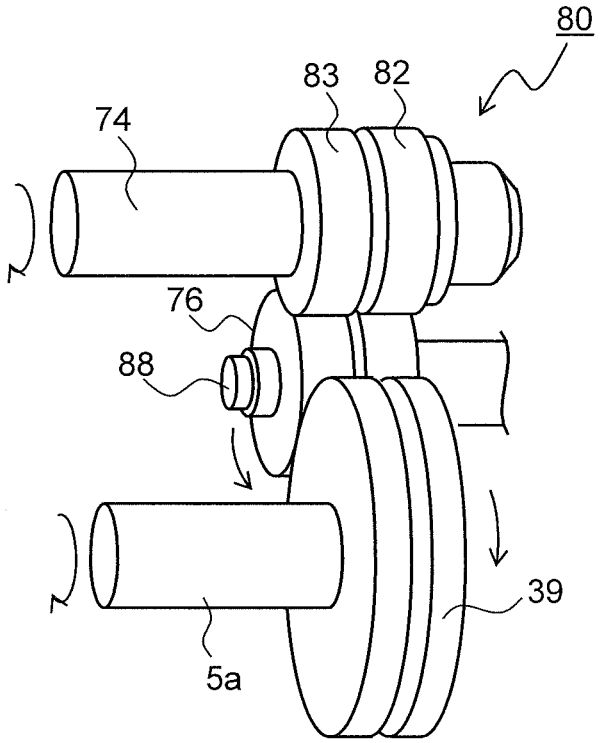
FIG. 6 is a perspective view of a first gear member 82 and a second gear member 83 constituting the drive mechanism 80, as well as a drum gear 39 and an idle gear 76 to be coupled to the drive mechanism 80.
Figure 7:
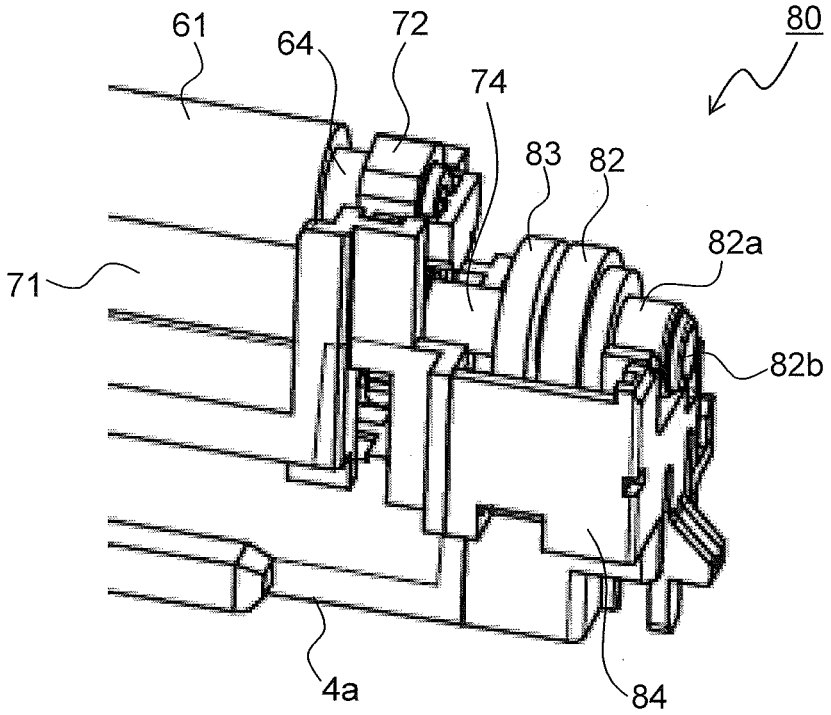
FIG. 7 is a perspective view showing a structure of around the drive mechanism 80 of the cleaning member 71, showing a state in which the cleaning member 71 has been moved closer to the first gear member 82.
Figure 8:
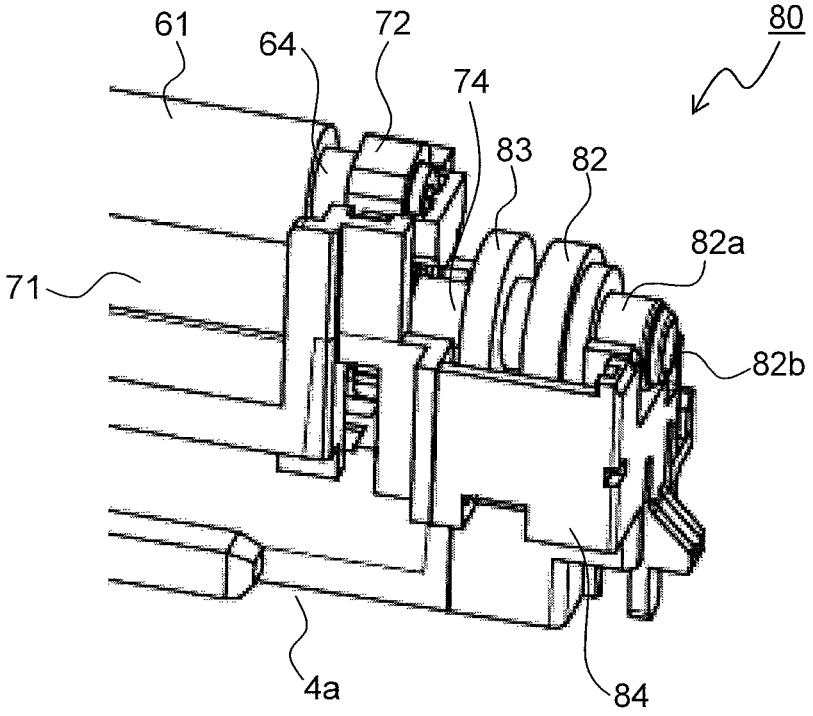
FIG. 8 is a perspective view showing a structure of around the drive mechanism 80 of the cleaning member 71, showing a state in which the cleaning member 71 has been moved farther from the first gear member 82.

FIG. 5 is a partial perspective view of around the drive mechanism 80 of the drum unit 30. FIG. 6 is a perspective view of a first gear member 82 and a second gear member 83 constituting the drive mechanism 80, as well as a drum gear 39 and an idle gear 76 to be coupled to the drive mechanism 80. FIGS. 7 and 8 are perspective views showing a structure of around the first gear member 82 and the second gear member 83 to be placed on the charging device 4 side of the drive mechanism 80. The drive mechanism 80 of the cleaning member 71 will be described below with reference to FIGS. 5 to 8. In addition, FIGS. 7 and 8 each show a state in which the charging roller 61 of the charging device 4 is positioned on the upper side, converse to FIGS. 5 and 6 in terms of up-and-down order.

As shown in FIGS. 5 and 6, the drive mechanism 80 includes a drum gear 39 fixed to the drum shaft 5*a* of the photosensitive drum 5, an idle gear 76 to be engaged with the drum gear 39, a first gear member 82 and a second gear member 83 to be engaged with the idle gear 76, and a coil spring 85 (see FIG. 4).

As shown in FIG. 7, the first gear member 82 and the second gear member 83 are housed in a housing part 84 of the frame 4*a*. The first gear member 82 is supported so as to be rotatable relative to the rotating shaft 74 of the cleaning member 71 and immovable in the axial direction of the rotating shaft 74, and the first gear member 82 has a cylindrical-shaped bearing portion 82*a* to be rotatably fitted to the rotating shaft 74 of the cleaning member 71. Also, an engagement recessed portion 82*b* is formed at a tip end of the bearing portion 82*a*. The second gear member 83 is fixed to the rotating shaft 74 so as to rotate along with the cleaning member 71. The idle gear 76 is rotatably supported by a pivotal shaft 88 of the gear holder 87 (see FIG. 12) fixed to the unit housing 30*a*.

Figure 9:
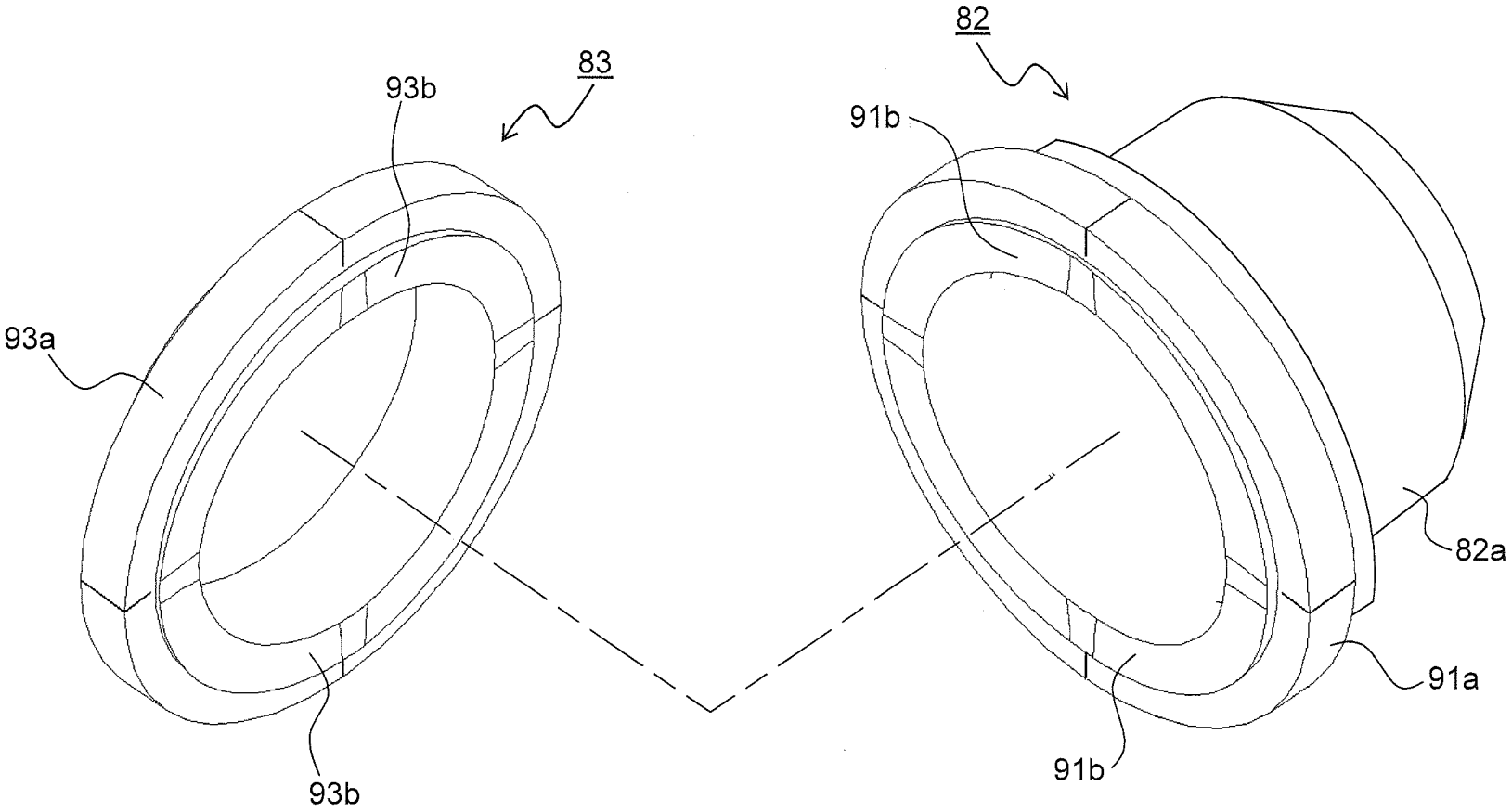
FIG. 9 is a perspective view of the first gear member 82 and the second gear member 83 constituting the drive mechanism 80.

FIG. 9 is a perspective view of the first gear member 82 and the second gear member 83 constituting the drive mechanism 80. The first gear member 82 has a first gear 91*a* and a cam follower 91*b*. The first gear 91*a* is a spur gear to be formed on the outer circumferential surface of the first gear member 82. The cam follower 91*b* is a protrusion protruding from a side face (left side face in FIG. 9) of the first gear member 82 which is opposed to a cam surface 93*b* of the second gear member 83. In the cam follower 91*b*, a maximal portion (protruding portion) and a minimal portion (recessed portion) are formed each one in number with a 180° interval therebetween so that the axial distance differs (a displacement occurs) in the circumferential direction of the first gear member 82.

The second gear member 83 has a second gear 93*a* and a cam surface 93*b*. The second gear 93*a* is a spur gear which is formed on the outer circumferential surface of the second gear member 83 and whose number of teeth equals to one smaller than that of the first gear 91*a* of the first gear member 82. Also, the second gear 93*a* is formed with such a shift that its pitch circle diameter is coincident with a pitch circle diameter of the first gear 91*a*. Forming the second gear 93*a* as a shifted gear allows the idle gear 76 to be securely engaged with the first gear 91*a* and the second gear 93*a*.

The cam surface 93*b* is a protrusion protruding from a side face (right side face in FIG. 9) of the second gear member 83 which is opposed to the cam follower 91*b* of the first gear member 82. In the cam surface 93*b*, a maximal portion (protruding portion) and a minimal portion (recessed portion) are formed each one in number with a 180° interval therebetween so that the axial distance differs (a displacement occurs) in the circumferential direction of the second gear member 83.

The coil spring 85 has one end in contact with the rotating shaft 74 of the cleaning member 71 and the other end protruding from one end portion of the frame 4*a* opposite to the drive mechanism 80 side. With the charging device 4 fitted to the drum unit 30, the coil spring 85 protruding from the frame 4*a* is put into contact with the first accommodating portion 31*a* of the unit housing 30*a* (see FIG. 3) so as to be compressed, biasing the cleaning member 71 toward the first gear member 82 side (in a first direction).

As the photosensitive drum 5 is driven into rotation, the drum gear 39 fixed to the photosensitive drum 5 is rotated, so that the idle gear 76 engaged with the drum gear 39 is also rotated. Then, the rotation of the idle gear 76 causes the first gear member 82 and the second gear member 83 to be rotated, so that the cleaning member 71 is rotated along with the rotating shaft 74 to which the second gear member 83 is fixed. Also, the charging roller 61 in contact with the photosensitive drum 5 is also rotated in subordination to the photosensitive drum 5. In this case, the cleaning member 71 and the charging roller 61 are rotated with a specified linear velocity difference.

In the rotation of the first gear member 82 and the second gear member 83, the difference in number of teeth between the first gear 91*a* and the second gear 93*a* causes the first gear member 82 and the second gear member 83 to be rotated at mutually different rotational speeds. Since the first gear member 82 and the second gear member 83 are rotated at different rotational speeds, the contact position between the cam follower 91*b* and the cam surface 93*b* is varied.

In this connection, the first gear member 82 having the cam follower 91*b* is restricted in movement in the axial direction (left/right direction in FIGS. 7 and 8) in the housing part 84. Therefore, the second gear member 83 having the cam surface 93*b* is reciprocatively moved in the axial direction along with the rotating shaft 74 in response to the contact position between the cam follower 91*b* and the cam surface 93*b*.

For example, when the cam follower 91*b* of the first gear member 82 and the cam surface 93*b* of the second gear member 83 have their minimal portions put into contact with each other, the axial distance between the first gear member 82 and the second gear member 83 becomes smaller as shown in FIG. 7, so that the rotating shaft 74 is moved by the biasing force of the coil spring 85 toward a direction of approaching the first gear member 82 (first direction, rightward direction in FIG. 7).

Meanwhile, when the cam follower 91*b* of the first gear member 82 and the cam surface 93*b* of the second gear member 83 have their maximal portions put into contact with each other, the axial distance between the first gear member 82 and the second gear member 83 becomes larger as shown in FIG. 8, so that the rotating shaft 74 is moved against the biasing force of the coil spring 85 toward a direction of separating from the first gear member 82 (second direction, leftward direction in FIG. 8).

According to the above-described constitution, as the photosensitive drum 5 is driven into rotation, the cleaning member 71 is rotated based on engagement between respective ones among the drum gear 39, the idle gear 76, the first gear member 82 and the second gear member 83 constituting the drive mechanism 80. Further, depending on the difference in rotational speed between the first gear member 82 and the second gear member 83, the contact position between the cam follower 91*b* of the first gear member 82 and the cam surface 93*b* of the second gear member 83 varies periodically, so that the second gear member 83 is reciprocatively moved in the axial direction along with the rotating shaft 74. As a result of this, the cleaning member 71 is reciprocatively moved in the axial direction while rotating in contact with the charging roller 61, thus being enabled to efficiently eliminate toner or other foreign matters sticking on the outer peripheral surface of the charging roller 61.

Figure 10:
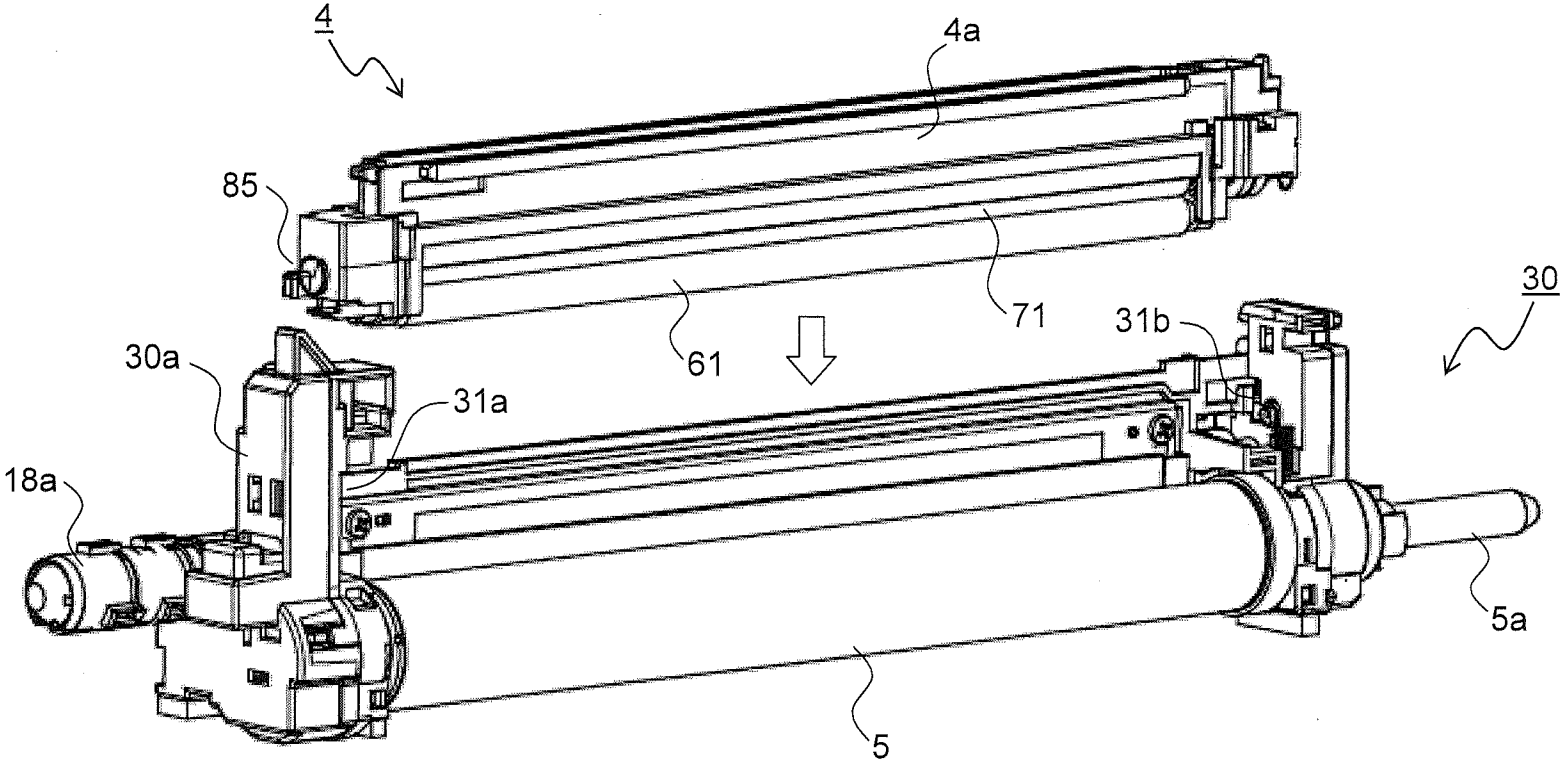
FIG. 10 is an appearance perspective view of the drum unit 30 and the charging device 4 prior to its being fitted to the drum unit 30.
Figure 11:
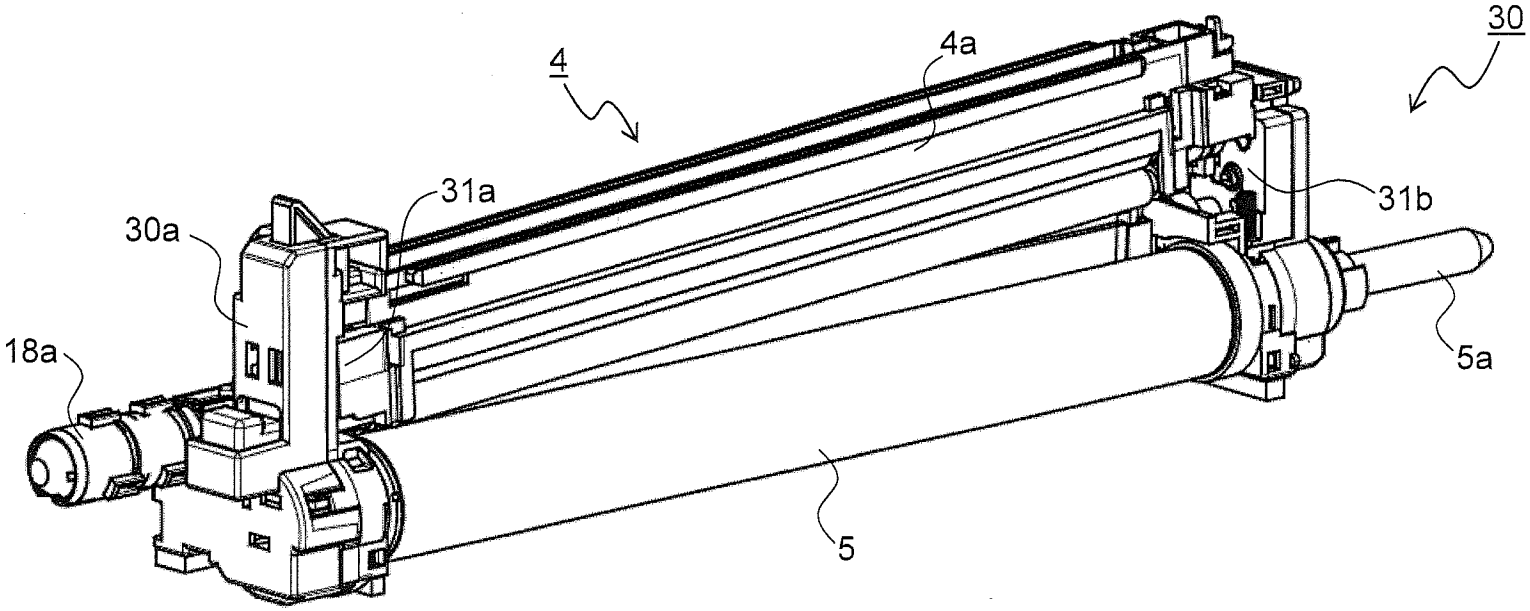
FIG. 11 is a perspective view showing a state in which one end portion of a frame 4*a* of the charging device 4 on one side on which a coil spring 85 is protruded has been inserted into a first accommodating portion 31*a* of a unit housing 30*a*, as it is succeeded from the state of FIG. 10.

Next, a method of fitting and removing the charging device 4 to and from the drum unit 30 will be described. For fitting of the charging device 4 to the drum unit 30, the charging device 4 is moved closer to the unit housing 30*a* from above as shown in FIG. 10. Then, as shown in FIG. 11, with the charging device 4 inclined, an end portion (left end portion in FIG. 4) of the frame 4*a* on the side on which the coil spring 85 is protruded is inserted into the first accommodating portion 31*a* of the unit housing 30*a*.

Then, while the coil spring 85 is compressed, an end portion (right end portion in FIG. 4) of the frame 4*a* at which the first gear member 82 is provided is moved closer to the unit housing 30*a* and inserted into the second accommodating portion 31*b* of the unit housing 30*a*.

Figure 12:
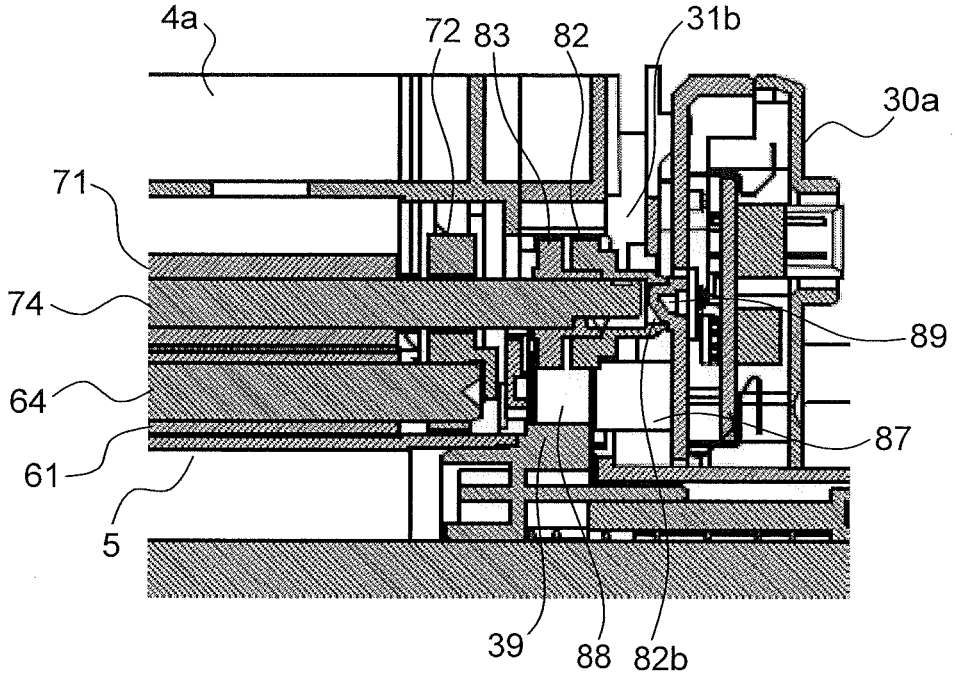
FIG. 12 is a partial enlarged view of around a second accommodating portion 31*b* of the drum unit 30 to which the charging device 4 has been fitted.
Figure 13:
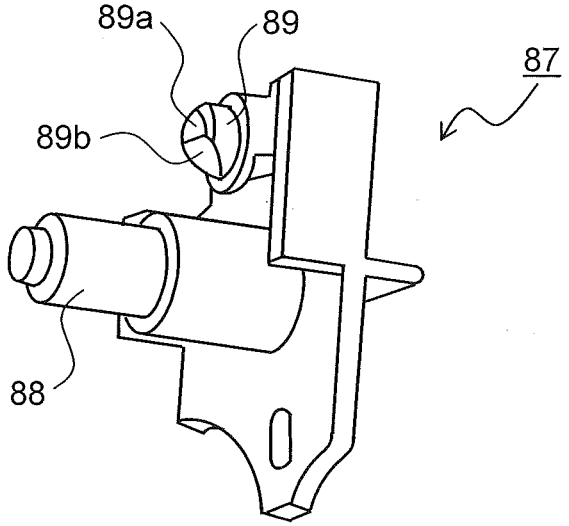
FIG. 13 is a perspective view of a gear holder 87 to be placed in the second accommodating portion 31*b*.
Figure 14:
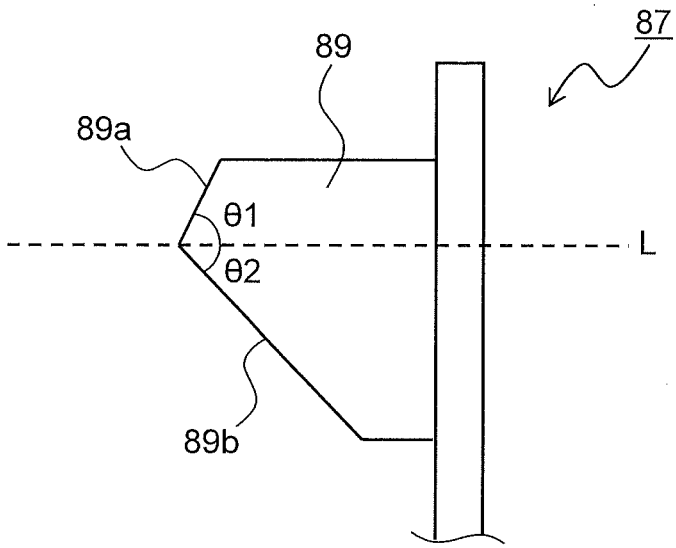
FIG. 14 is a side view of an engagement protruding portion 89 to be formed in the gear holder 87.

FIG. 12 is a partial enlarged view of around the second accommodating portion 31*b* (within the broken-line circle in FIG. 3) of the drum unit 30 to which the charging device 4 has been fitted. FIG. 13 is a perspective view of the gear holder 87 to be placed in the second accommodating portion 31*b*. FIG. 14 is a side view of an engagement protruding portion 89 to be formed in the gear holder 87.

As shown in FIG. 13, the gear holder 87 includes a pivotal shaft 88 for rotatably supporting the idle gear 76, and an engagement protruding portion 89. The engagement protruding portion 89 has a first inclined surface 89*a* and a second inclined surface 89*b* formed so as to be inclined toward the fitting-and-removing direction (up/down direction in FIG. 13) of the charging device 4.

When the end portion (right end portion in FIG. 11) of the frame 4*a* at which the first gear member 82 is provided is inserted into the second accommodating portion 31*b*, the peripheral edge portion of the engagement recessed portion 82*b* formed at the tip end of the bearing portion 82*a* of the first gear member 82 is moved over the engagement protruding portion 89 along the first inclined surface 89*a*, so that the engagement recessed portion 82*b* and the engagement protruding portion 89 are engaged with each other. As a result of this, the charging device 4 is fitted to the unit housing 30*a* as shown in FIGS. 2 and 3. In this state, the cleaning member 71 is biased toward the first gear member 82 side by the coil spring 85, eliminating the fear that the engagement recessed portion 82*b* and the engagement protruding portion 89 may easily be disengaged from each other.

For removal of the charging device 4 from the drum unit 30, in the state of FIGS. 2 and 3, the end portion (right end portion in FIGS. 2 and 3) of the frame 4*a* at which the first gear member 82 is provided is separated from the unit housing 30*a*. As a result, the peripheral edge portion of the engagement recessed portion 82*b* is moved over the engagement protruding portion 89 along the second inclined surface 89*b* against the biasing force of the coil spring 85, so that the engagement recessed portion 82*b* and the engagement protruding portion 89 are disengaged from each other.

According to this constitution, since the charging device 4 is fittable and removable in a direction perpendicular to the longitudinal direction of the drum unit 30, the fitting-and-removing mechanism for the charging device 4 to the drum unit 30 can be simplified and moreover the operability in the fitting and removing process can be improved. Also, since the engagement state between the engagement recessed portion 82*b* and the engagement protruding portion 89 is retained by using the biasing force of the coil spring 85 forming part of the drive mechanism 80 of the cleaning member 71, there can be eliminated the need for additionally providing a mechanism for locking the charging device 4 to the unit housing 30*a*. Therefore, the charging device 4 and the drum unit 30 can be reduced in parts count and moreover their downsizing and cost reduction can be fulfilled.

Also as shown in FIG. 14, an inclination angle θ1 formed against a horizontal plane L by the first inclined surface 89*a*, with which the engagement recessed portion 82*b* is put into contact in the fitting process of the charging device 4, is larger than an inclination angle θ2 formed against the horizontal plane L by the second inclined surface 89*b*, with which the engagement recessed portion 82*b* is put into contact in the removal process of the charging device 4.

Whereas the removal of the charging device 4 from the drum unit 30 involves an action of grasping and pulling upward one end of the charging device 4, in which case force can less easily be exerted, setting a small inclination angle θ2 of the second inclined surface 89*b* makes it possible to allow the peripheral edge portion of the engagement recessed portion 82*b* to be easily moved over the engagement protruding portion 89 along the second inclined surface 89*b*. Therefore, the charging device 4 can be removed from the drum unit 30 with light force, facilitating the removal work. Meanwhile, fitting of the charging device 4 to the drum unit 30 involves an action of pushing down the charging device 4, in which case force can more easily be exerted, so that a large inclination angle θ1 of the first inclined surface 89*a* does not matter.

Otherwise, the present disclosure is not limited to the above embodiment and may be changed and modified in various ways without departing from the gist of the disclosure. For example, whereas the cam follower 91*b* is formed in the first gear member 82 and the cam surface 93*b* is formed in the second gear member 83 in the above-described embodiment, it is also allowable that the cam surface is formed in the first gear member 82 and the cam follower is formed in the second gear member 83. Also, whereas the engagement recessed portion 82*b* is provided on the charging device 4 side and the engagement protruding portion 89 is provided on the unit housing 30*a* side in the above embodiment, it is also allowable that the engagement protruding portion is provided on the charging device 4 side and the engagement recessed portion is provided on the unit housing 30*a* side.

The above embodiment has been given on a case in which the first gear 91*a* of the first gear member 82 and the second gear 93*a* of the second gear member 83, which constitute the drive mechanism 80, are made different in number of teeth from each other so as to allow the rotating shaft 74 of the cleaning member 71 to reciprocatively move while rotating. However, the present disclosure is not limited to this, and a mechanism for rotating the rotating shaft 74 of the cleaning member 71 may be provided additionally independent of the mechanism for reciprocatively moving the rotating shaft 74 in the axial direction. Further, whereas the first gear member 82 and the second gear member 83 are used as moving members for moving the rotating shaft 74 in a direction counter to the biasing force of the coil spring 85 in the above embodiment, such other moving members as eccentric cams may also be used.

Without being limited to digital MFPs (Multi-Function Peripherals, i.e., apparatuses having multiple functions of copier, facsimile, scanner and the like) such as shown in FIG. 1, the present disclosure is absolutely similarly applicable also to other image forming apparatuses having the drum unit 30 to and from which the charging device 4 can be fitted and removed, such as monochrome printers, color printers and monochrome/color copiers.

The present disclosure is applicable for image carrier units made up by unitizing an image carrier and a charging device for electrically charging the image carrier, as well as for image forming apparatuses including such an image carrier unit. By the use of the present disclosure, there can be provided an image carrier unit, as well as an image forming apparatus including the image carrier unit, by which the charging device can be held with a simple construction and by which the operability in fitting and removal of the charging device can be improved.

What is claimed is:

1. An image carrier unit comprising:

an image carrier on which an electrostatic latent image is to be formed;

a charging device including a charging member for electrically charging a surface of the image carrier by making contact with the image carrier, a cleaning member for cleaning the charging member by making contact with the charging member, and a frame for rotatably supporting a rotating shaft of the charging member and moreover rotatably and axially-movably supporting a rotating shaft of the cleaning member;

a unit housing for integrally holding the image carrier and the charging device; and a drive mechanism including a biasing member for biasing the rotating shaft of the cleaning member in a first direction extending along its axial direction, and a moving member for moving the rotating shaft of the cleaning member against biasing force of the biasing member with a constant periodicity in a second direction opposite to the first direction, the drive mechanism serving for reciprocatively moving the rotating shaft of the cleaning member in the axial direction, wherein the charging device is fittable to and removable from the unit housing in a direction perpendicular to its longitudinal direction, and an engaging portion to engage with an engaged portion of the unit housing is formed at one longitudinal end portion of the charging device, and an engagement state between the engaging portion and the engaged portion is retained by biasing force of the biasing member protruding from the other longitudinal end portion of the charging device, the engaging portion is an engagement recessed portion formed at one end portion of the charging device, and the engaged portion is an engagement protruding portion formed at an inner side face of the unit housing opposite to the engagement recessed portion, the engagement protruding portion has a first inclined surface with which a peripheral edge portion of the engagement recessed portion is to be put into contact in fitting of the charging device, and a second inclined surface with which the peripheral edge portion of the engagement recessed portion is to be put into contact in removal of the charging device, the moving member is composed of a first gear member which rotatably supports one end of the rotating shaft of the cleaning member and whose axial movement is restricted, and a second gear member which is fixed to the rotating shaft of the cleaning member so as to face the first gear member, the moving member has a cam surface which is provided at one side face out of opposing side faces of the first gear member and the second gear member and whose axial distance is continuously varied in its circumferential direction, and a cam follower which is provided at the other side face and which is to be put into contact with the cam surface, the biasing member biases the rotating shaft of the cleaning member in the first direction in which the cam surface and the cam follower are put into contact with each other, and the engagement recessed portion is formed in the first gear member.

2. The image carrier unit according to claim 1, wherein an inclination angle of the first inclined surface to a horizontal surface is larger than an inclination angle of the second inclined surface to the horizontal surface.

3. The image carrier unit according to claim 1, wherein the biasing member is a coil spring whose one end side is put into contact with the rotating shaft of the cleaning member and whose other end side is protruded from an end portion of the frame on its one side opposite to a side on which the drive mechanism is provided, and wherein by the charging device being fitted to the unit housing, the other end side of the coil spring is put into contact with the unit housing, causing the coil spring to be compressed, whereby the cleaning member is biased in the first direction.

4. An image forming apparatus comprising the image carrier unit according to claim 1.

* * * * *